United States Patent [19]

Roccaforte

[11] Patent Number: 4,498,619

[45] Date of Patent: Feb. 12, 1985

[54] CARTON WITH CARRYING HANDLE

[75] Inventor: Harry I. Roccaforte, Western Springs, Ill.

[73] Assignee: Champion International Corporation, Stamford, Conn.

[21] Appl. No.: 544,866

[22] Filed: Oct. 24, 1983

[51] Int. Cl.[3] ..... B65D 5/46

[52] U.S. Cl. ..... 229/52 B; 229/37 R; 229/DIG. 6; 229/DIG. 9

[58] Field of Search ..... 229/52 B, 37 R, 54 R, 229/52 A, DIG. 6, DIG. 9; 150/12

[56] References Cited

U.S. PATENT DOCUMENTS

| | | | |
|---|---|---|---|
| 2,986,324 | 5/1961 | Anderson, Jr. | 229/52 B |
| 4,222,485 | 9/1980 | Focke | 229/52 B |
| 4,397,393 | 8/1983 | Pergande et al. | 229/52 B |
| 4,415,117 | 11/1983 | Polland | 229/52 B |
| 4,436,244 | 3/1984 | Morris | 229/52 B |

*Primary Examiner*—Joseph Man-Fu Moy
*Attorney, Agent, or Firm*—Evelyn M. Sommer

[57] ABSTRACT

A carton has a handle formed on its top. The carton comprises top and bottom walls connected by a tubular body. The top wall has inner and outer panels extending from opposite sides of said tubular body which are overlapped and secured together. Opposed ends of the inner top wall panel are also adhesively secured to flaps extending therebeneath from opposed said walls. An elongated extensible handle panel is formed from a portion of the overlapped inner and outer top wall panels and the side wall flaps which is substantially equally spaced from the tubular body opposite sides by providing a pair of perforated spaced score lines in the inner and outer top wall panels, which score lines extend substantially parallel to a free edge of the inner and outer top wall panels, and parallel perforated score lines in each side wall flap substantially colinear with the score lines in the top panels, the latter extending downwardly into each adjacent side wall. This handle panel lies flat against the top wall of the carton and is readily extensible into a use position by lifting and tearing the top wall panel and side wall flaps along the score lines to form a carrying handle.

14 Claims, 21 Drawing Figures

Fig. 17.
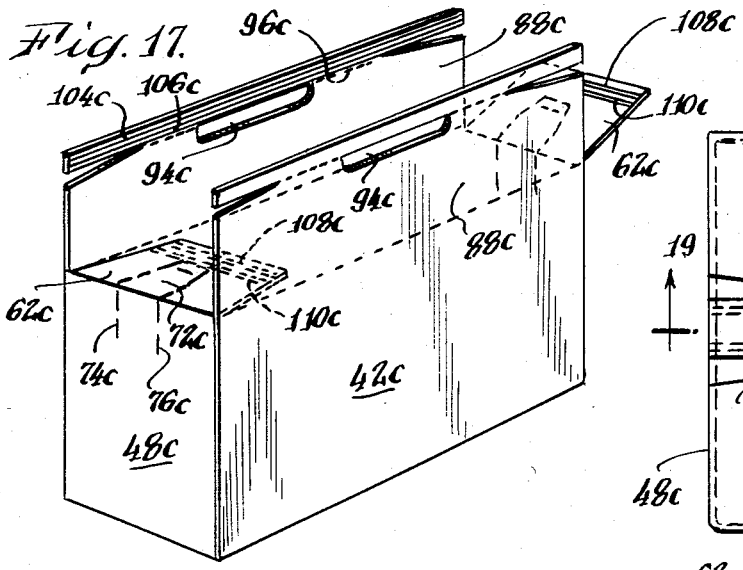
Fig. 18.
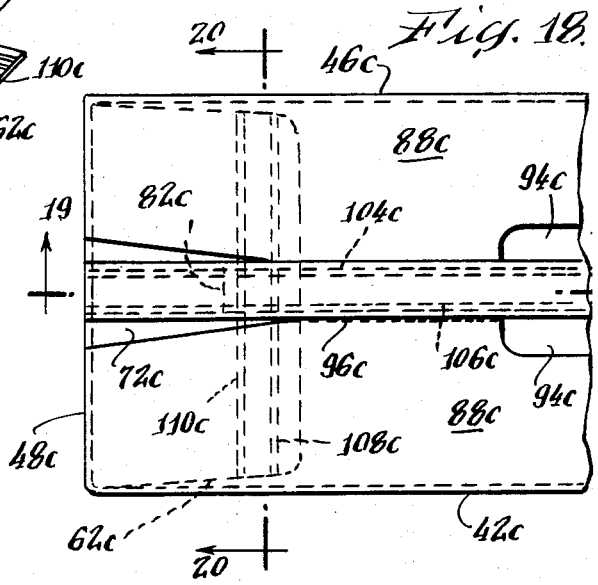
Fig. 19.
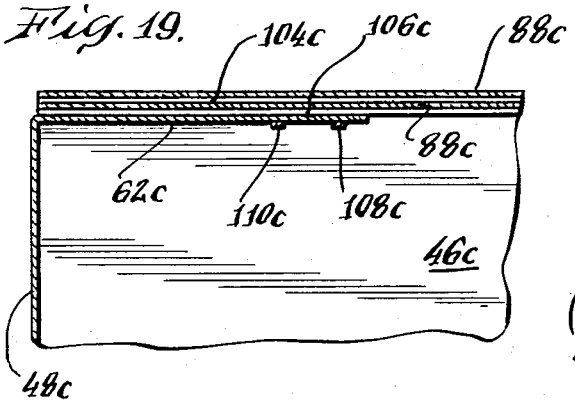
Fig. 20.
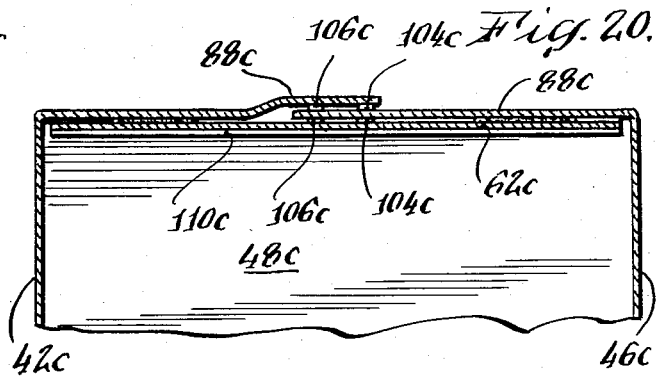
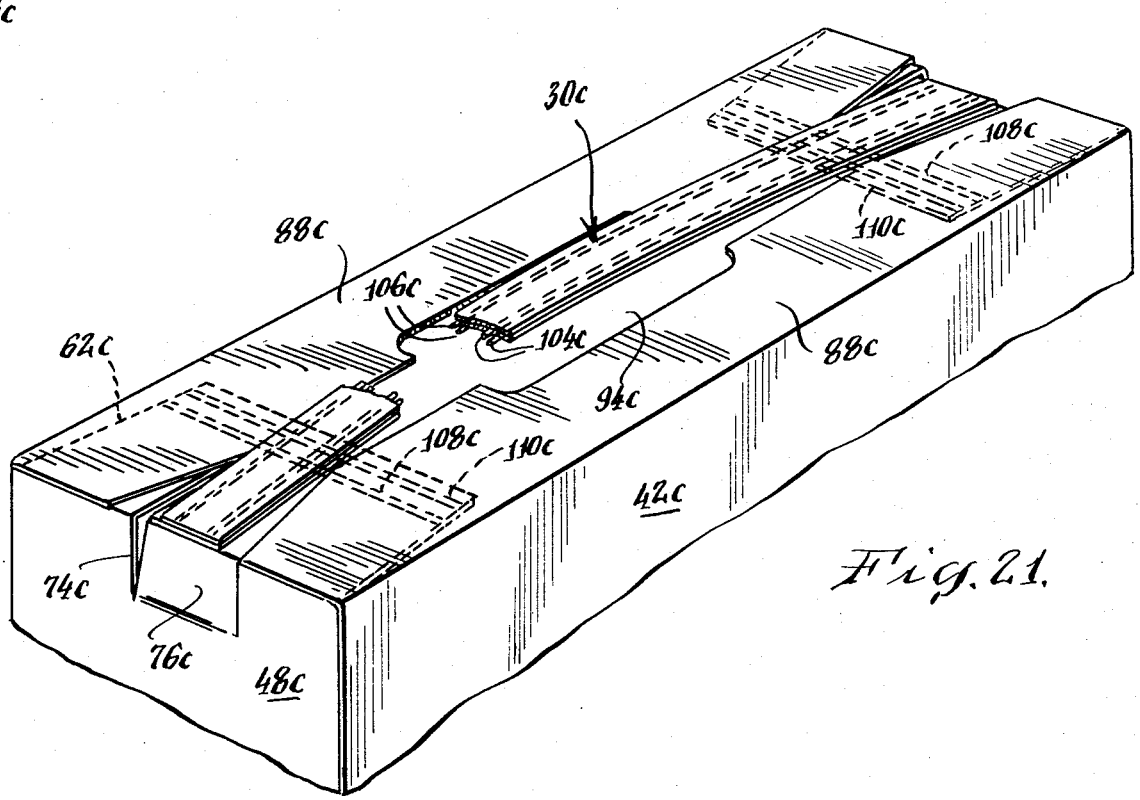
Fig. 21.

CARTON WITH CARRYING HANDLE

BACKGROUND OF THE INVENTION

1. Field of the Invention

The present invention relates to a carton having a handle formed on its top wall, and a blank for forming the carton. More particularly, the invention relates to a reinforced handle arrangement which is centrally located on the carton top wall, is aligned with the carton center of gravity and can be easily separated from the carton top wall along a pair of spaced score lines.

2. Description of the Prior Art

Cartons or containers for large quantities of consumer articles are often provided with a handle to facilitate carrying the carton with its contents. Preferably, this handle is formed from a unitary portion of the blank used to form the remainder of the carton to simplify construction of the carton and to minimize expenses. For cartons containing relatively heavy articles, such as cans of beer or other beverages, the carton must be sufficiently strong to withstand the considerable weight of the carton and its contents.

In one known carton, the handle comprises two U-shaped panels which overlie one another and extend angularly outwardly from one of the top edges of the carton. Since the handle extends from an edge of the carton, it is offset from the center of gravity of the carton causing the carton to hang at an angle when held by the handle. The angular hanging of the carton makes carrying difficult and interferes with walking. This carton is also deficient in not having a suitably strong handle arrangement. Further, the angular extension of the handle interfers with packing.

Accordingly, in U.S. Pat. No. 4,378,905, issued April 5, 1983 to the same assignee as the present invention, a blank for forming a carton comprising a front panel, inner and outer top panels, a bottom panel and a back panel is disclosed. The inner top panel is hingedly coupled to an end edge of the front panel along a fold line. The bottom panel is hingedly coupled to an end edge of the front panel remote from the inner top panel along a fold line. The back panel is hingedly coupled to an end edge of the bottom panel remove from the front panel along a first fold line. The outer top panel is hingedly coupled to an end edge of the back panel remote from the bottom panel along a fold line. A perforated score line is formed in the top outer panel and extends parallel to the first fold line completely across the top outer panel and is spaced from the first fold line and a free edge of the top outer panel. The outer top panel is sealed to and over an inner top panel foldably connected to an edge of the front panel.

By forming the carton and the blank in this manner, the carton can be provided with a handle which is centered on the top wall of the carton and aligned with the center of gravity of the carton. Since the handle is formed from an unsealed end portion of the outer top wall panel, the carton must be otherwise completely sealed along its top wall by securing the remainder of the outer top panel to the inner top panel, prior to being filled with product. The score line holds the handle flat against the carton to facilitate shipping and storage, while permitting the handle to be readily accessible to the consumer by merely tearing and raising along the perforated score line.

Because of the specific, detailed and precise prefolds which are necessary in the particular construction of the handle panel in the top wall resulting in the forming and sealing of the top wall prior to shipment of the blank to the end user of the carton, it is necessary to fill and load the carton through a side wall or a wall opening located 90° from the handle panel. The handle is located in a panel other than the loading end of the carton.

There is a need for a strap-type carrying handle carton where the strap handle is located in the same wall or at the same end where the product is loaded into the carton. The carton of the present invention satisfies this requirement without increasing the cost of paperboard material needed to form such a carton, since the amount of board required to obtain the strap handle is no more than what would be required to form a standard carton overlap and seal closure.

SUMMARY OF THE INVENTION

In accordance with this invention, the carton comprises top and bottom walls connected by a tubular body. Opposed ends of the inner top wall panel are also adhesively secured to flaps extending therebeneath from opposed said walls. An elongated extensible handle panel is formed from a portion of the overlapped inner and outer top wall panels and the side wall flaps which is substantially equally spaced from the tubular body opposite sides by providing a pair of perforated spaced score lines in the inner and outer top wall panels, which score lines extend substantially parallel to a free edge of the inner and outer top wall panels, and parallel perforated score lines in each side wall flap colinear with the score lines in the top panels, the latter extending downwardly into each adjacent side wall. This handle panel lies flat against the top wall of the carton and is readily extensible into a use position by lifting and tearing the top wall panel and side wall flaps along the score lines to form a carrying handle.

Since the top wall is formed from overlapping flaps which can be sealed in a conventional manner, the carton blank can be erected and filled through the top wall at a distributors location, prior to sealing of the top wall.

BRIEF DESCRIPTION OF THE DRAWINGS

Further objects and advantages of the present invention will become apparent from the following description and claims, and from the accompanying drawings, wherein:

FIG. 17 is a perspective view of the carton formed from the blanks of FIGS. 16 and 17;

FIG. 18 is a partial top plan view of the carton of FIG. 17 with the top of the carton folded to a closed position;

FIG. 19 is a cross-sectional view taken substantially along the plane indicated by line 19—19 of FIG. 18;

FIG. 20 is a cross-sectional view taken substantially along the plane indicated by line 20—20 of FIG. 18; and FIG. 21 is a partial perspective view of the top wall of the carton of FIG. 17 when closed and the handle raised into an extended use position.

DETAILED DESCRIPTION OF THE PREFERRED EMBODIMENTS

Figure 1:
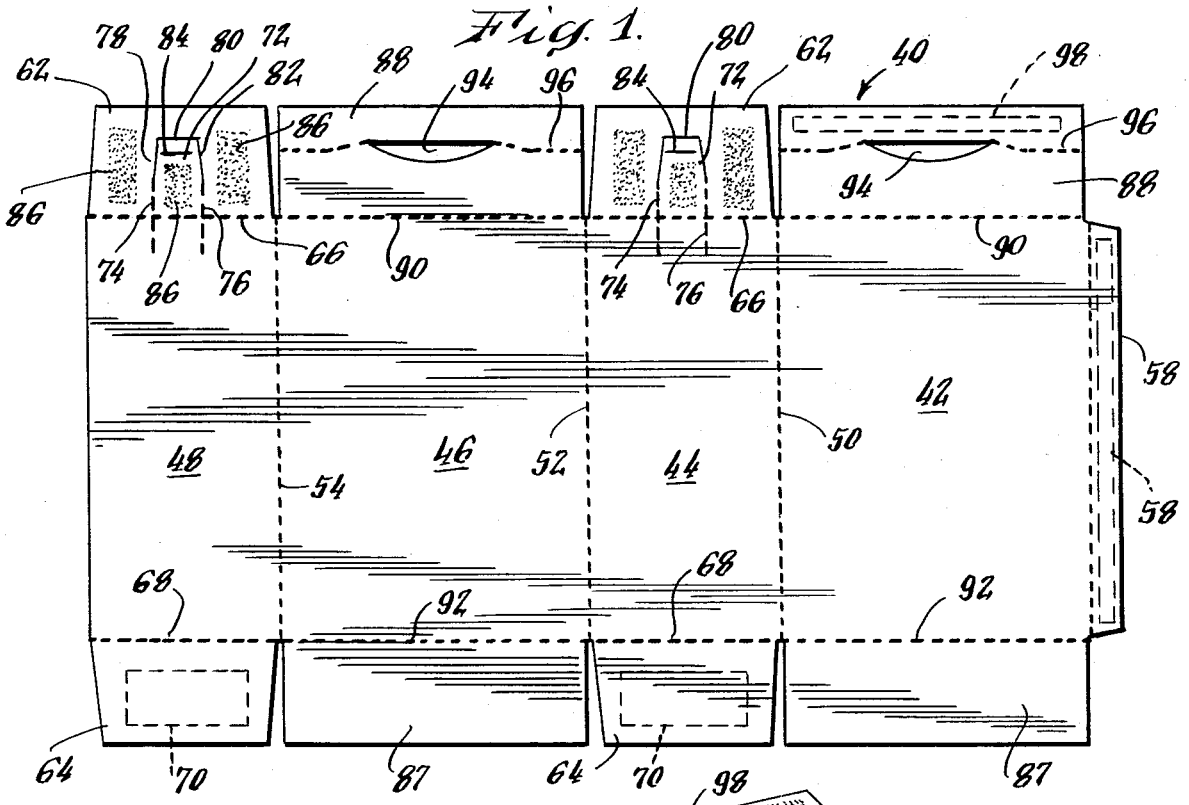
FIG. 1 is a plan view of a blank used to form the carton of the present invention.

Referring now to the drawings in detail, wherein like numerals indicate like elements throughout the several views, the carton 12 of the present invention in its assembled configuration has a top wall 14, a front wall 16, a back wall 18, a bottom wall 20, and two opposed side walls 22 and 24. These walls are rectangular in shape and define a rectangular parellopiped when folded and coupled.

Figure 9:
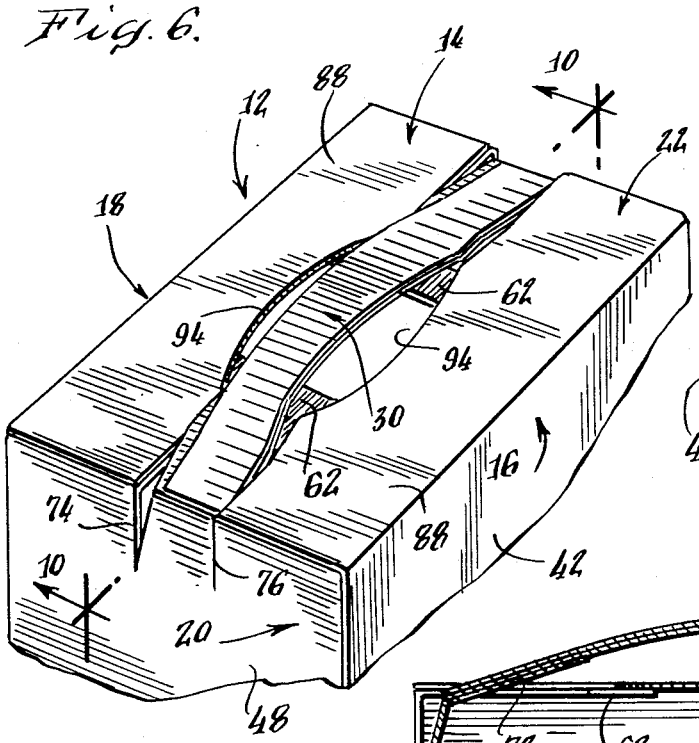
FIG. 9 is a perspective view of the top wall of the carton of the present invention with the handle formed therein in a use position.
Figure 8:
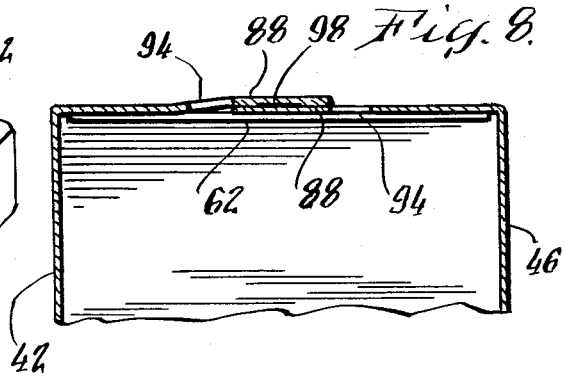
FIG. 8 is a cross-sectional view taken substantially along the plane indicated by line 8—8 of FIG. 5.
Figure 10:
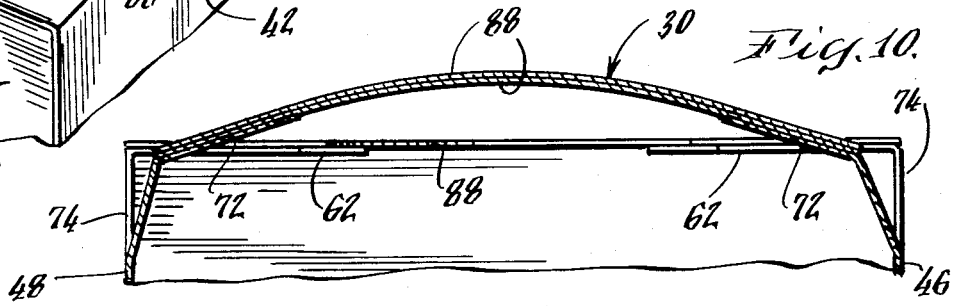
FIG. 10 is a cross-sectional view taken substantially along the plane indicated by line 10—10 of FIG. 9.

An elongated handle panel 30 is provided on top wall 14 and extends parallel to front and back wall 16, 18 and perpendicular to side walls 20, 22. Handle panel 30 is centered on top wall 14 in that it is substantially equal spaced from front and back walls 16, 18. The longitudinal axis of handle panel 30 lies in a plane parallel to front and back walls 16, 18 that contains the center of gravity of carton 10. To facilitate storage and handling, handle panel 30 initially lies flat against top wall 14 as illustrated in FIGS. 5, 6, 7, and 8. When a consumer needs to carry a carton 12 by handle panel 30, the consumer separates handle panel 30 from the remainder of top wall 14 by grasping and pulling it upwardly as illustrated in FIGS. 9 and 10 separating handle panel 30 from the remainder of top wall 14.

A planar unitary blank 40 for forming a carton 12 is illustrated in FIG. 1. Blank 40 can be formed of a unitary piece of paperboard of suitable weight and thickness. The weight and thickness of the paperboard depends on the size and weight of the articles contained within carton 12. FIG. 1 illustrates the surface of blank 40 which will form the interior surface of carton 12 illustrated in FIGS. 5–10, inclusive.

Blank 40 comprises a front wall panel 42, a first side wall panel 44, a back wall panel 46, and a second side wall panel 48. Each of these panels are rectangular with panels 42 and 46 and panels 44 and 48 being equal in size. Front and back wall panels 42 and 46 are hingedly coupled to first side wall panel 44 at opposite end edges thereof along fold lines 50 and 52, respectively. Back wall panel 46 is hindgedly coupled to second side wall panel 48 by a fold line 54. A glue flap 56 provided with an adhesive strip 58 on its outer surface thereof is foldably connected along a line 60 to an end edge of front panel 42.

Side wall panels 44 and 48 have upper and lower side wall flaps 62 and 64, respectively, foldably connected along upper and lower fold lines 66, 68 respectively, to the side wall panels 44 and 48, respectively. The outer surfaces of lower side wall flaps 64 are provided with adhesive areas 70. Cut in the central portion of each of the upper side wall flaps 62 is a substantially U-shaped tab 72 defined by a pair of spaced perforated score lines 74, 76 whose top ends are tapered and die cut completely through the paperboard along three sides 78, 80 and 82 to form the U-shaped end portion of the tab 72. The outer end of perforated score lines 74, 76 extend down into and terminate in the adjacent side wall panel 44 or 48. Tab 72 is also provided with an interior die cut line 84 parallel to but spaced from the bight or die cut line 80 of the end portion of tab 72 for a purpose which will be described hereinafter. The exterior surface of each of the side wall flaps 62 is provided with three adhesive areas 86 on tab 72 and adjacent portions of side wall flaps 62.

Each of the front and back wall panels 42, 46 is also provided with a bottom and top wall panel flap 87, 88, respectively. Each of the top wall panel flaps 88 is connected to the front and back panel respectively, by a fold line 90 while the bottom wall flaps 87 are connected to the front and bottom walls by fold line 92, respectively. Each of the top wall panels 88 is provided with a half-moon cut out area 94 whose ends are contiguous to a perforated score line 96 extending completely across the remainder or entire width of each of the top wall panels 88. The outer surface of the top wall panel 88 connected to front wall panel 42 is provided with an adhesive area 98.

Figure 3:
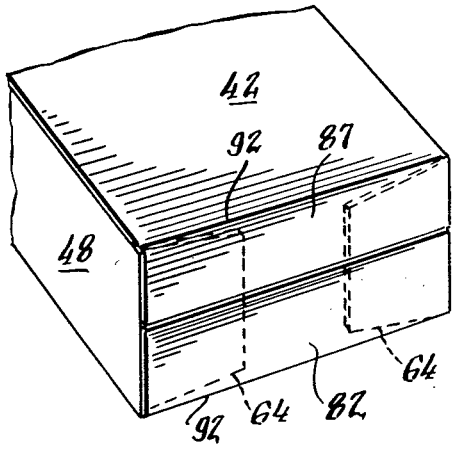
FIGS. 2 to 4, inclusive, are perspective views illustrating various successive steps in folding the blank of FIG. 1 into the carton of the present invention.
Figure 2:
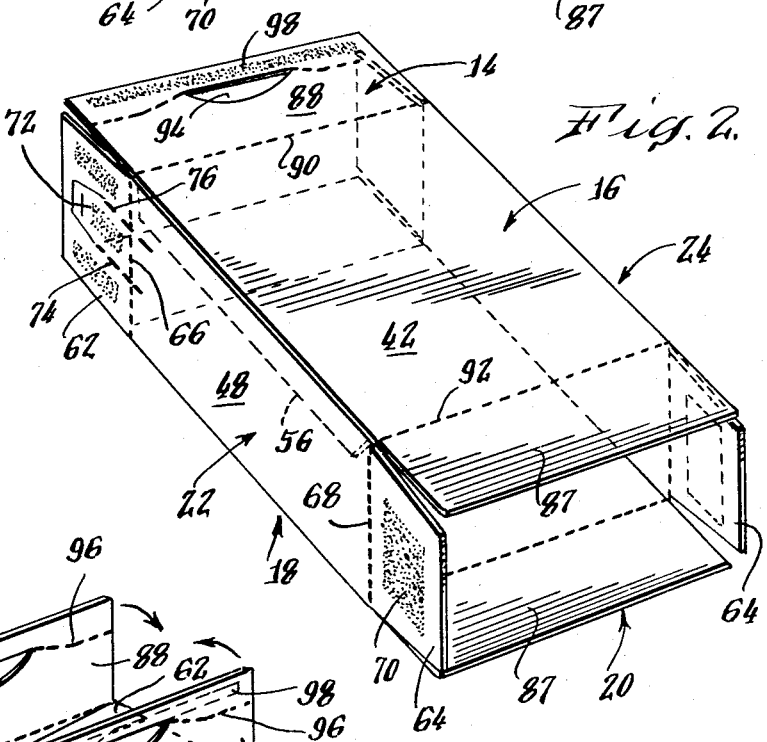
Figure 4:
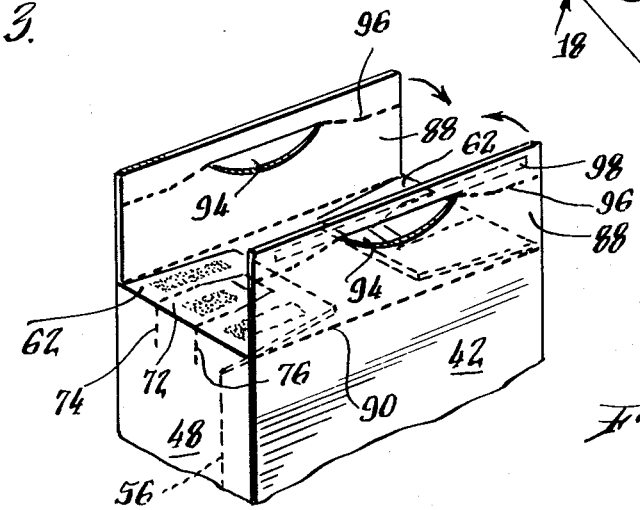
Figure 5:
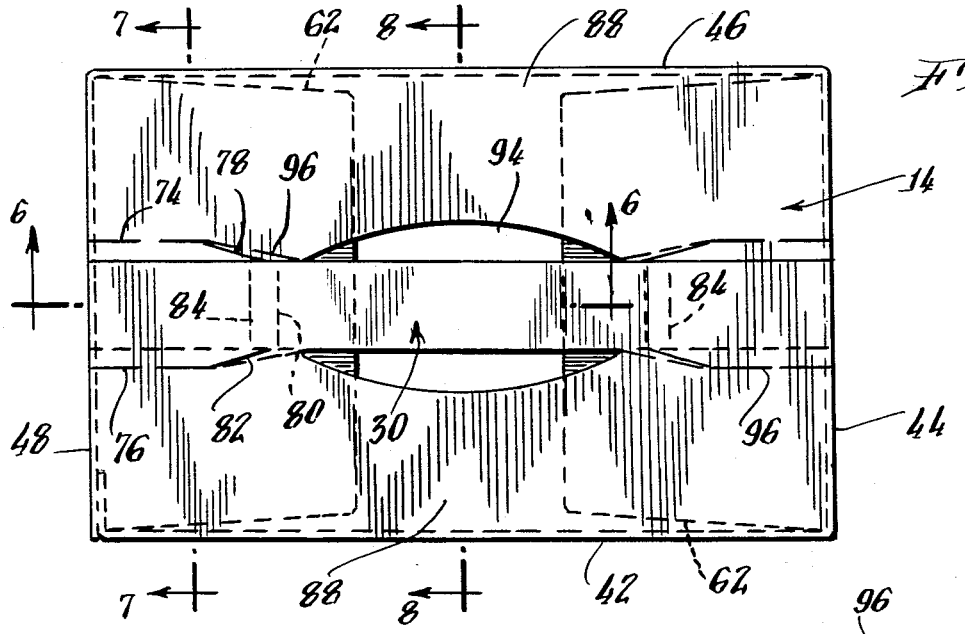
FIG. 5 is a top plan view of the top wall of the carton of the present invention formed from the blan of FIG. 1.
Figure 6:
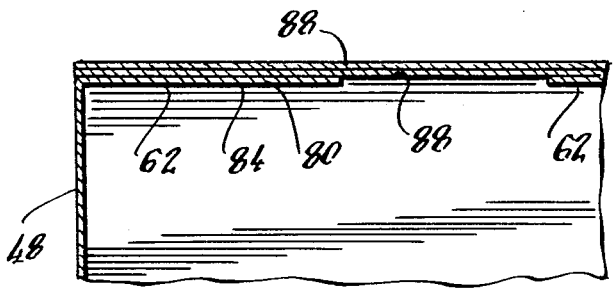
FIG. 6 is a cross-sectional view taken substantially along the plane indicated by line 6—6 of FIG. 5.
Figure 7:
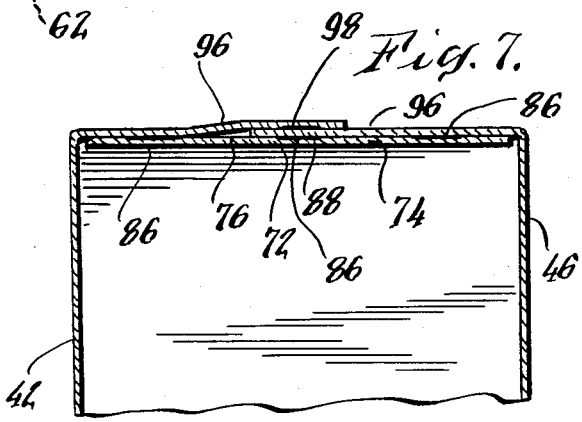
FIG. 7 is a cross-sectional view taken substantially along the plane indicated by line 7—7 of FIG. 5.

Carton 12 is formed from blank 40 as illustrated in FIGS. 2, 3, and 4. First, blank 40 is formed into a tube by folding front and back wall panels 42 and 46 into parallel alignment about fold lines 50 and 52. A second side wall panel 48 is then folded into parallel alignment about fold line 54 with first side wall panel 44 and glue flap 56, folded about score line 60 is connected along adhesive area 58 to the interior surface of second side wall flap 48 to form the rectangular parallelopiped configuration illustrated in FIG. 2, open at opposite top and bottom walls.

At this point the bottom wall 20 can be formed by folding side wall extension flaps 64 about their respective fold lines 68 and then folding the bottom wall flaps 87 connected to front and back walls panels 42, 46, respectively, about score lines 92 until they abut and securing them to the adhesive areas 70 on the exterior surface of flaps 64. This is illustrated in FIG. 3.

Carton 10 can then be filled or loaded with cans or other material through the open top wall 12. After loading, top wall 12 can be secured by folding side wall flap extensions 62 90° about their fold lines 66 connecting them to first and second side wall panels 44 and 48, respectively, and then rotating top wall panels 88 about their score line 90 so that the portion of the top wall panel 88 connected to back wall panel 46 between perforated score line 96 and the free edge of the top wall panel 88 overlies the similar portion of the top wall panel 88 connected to the front wall panel 42, with each score line substantially colinear with the free top edge of each of the other panels 88. This forms a handle panel 30 between the parallel, spaced score lines 96 as the free edge of each of the top wall panels 88 is aligned with a scoreline 96 on the panel therebeneath or overlapping therewith. The spaced, parallel scorelines 96 on the top wall 14 will also be colinear with one of the scorelines 74, 76 defining the spaced outer edges of side wall tabs 72.

The top wall panel 88 connected to back wall panel 46 which overlies the top wall panel 88 connected to front wall panel 42 is secured along adhesive area 98 to the top wall panel connected to front wall panel 42. The opposed ends of overlapped and secured top wall panels 88 are then secured by the adhesive areas 86 contacting the bottom of the top wall panel 88 secured to front wall panel 42 to panels 62.

In order to use handle panel 30, is only necessary to insert the fingers in the half-moon openings 94 surrounding the handle panel 30, as shown in FIGS. 9 and 10 and pull upwardly causing the handle panel 30 to separate from the top wall and side wall flaps 62 along parallel score lines 96, and 74, 76 to flex the handle inwardly about a line connecting the ends of perforated score lines 74, 76 in each side wall panel 44, 48 and cause it to rise above the plane of the top wall where it can be grasped to carry the carton 12 along with its contents.

The die cut slit 82 formed in each tab 72 eliminates the possiblity of the higher portion 80 of each tab 72 not separating from the plane of side wall tab 62 and thus causing the adhesive areas 86 to separate from overlapped top wall panels 88. The slit 82 assures that each tab 72 will bend and separate at edge 80.

The resultant handle panel 30 is of a three-ply reinforced construction at its ends where joined to side wall panels 44, 46, namely comprising upper and lower overlapped top panels 88 and sidewall tabs 72, for increased strength.

Figure 11:
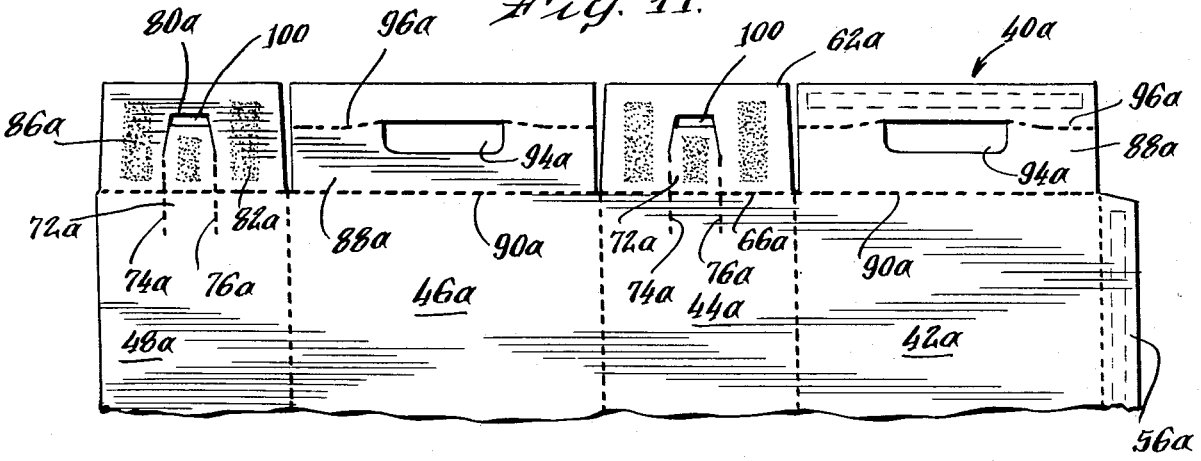
FIG. 11 is a partial plan view of a blank used to form a modified embodiment of the carton of the present invention.
Figure 12:
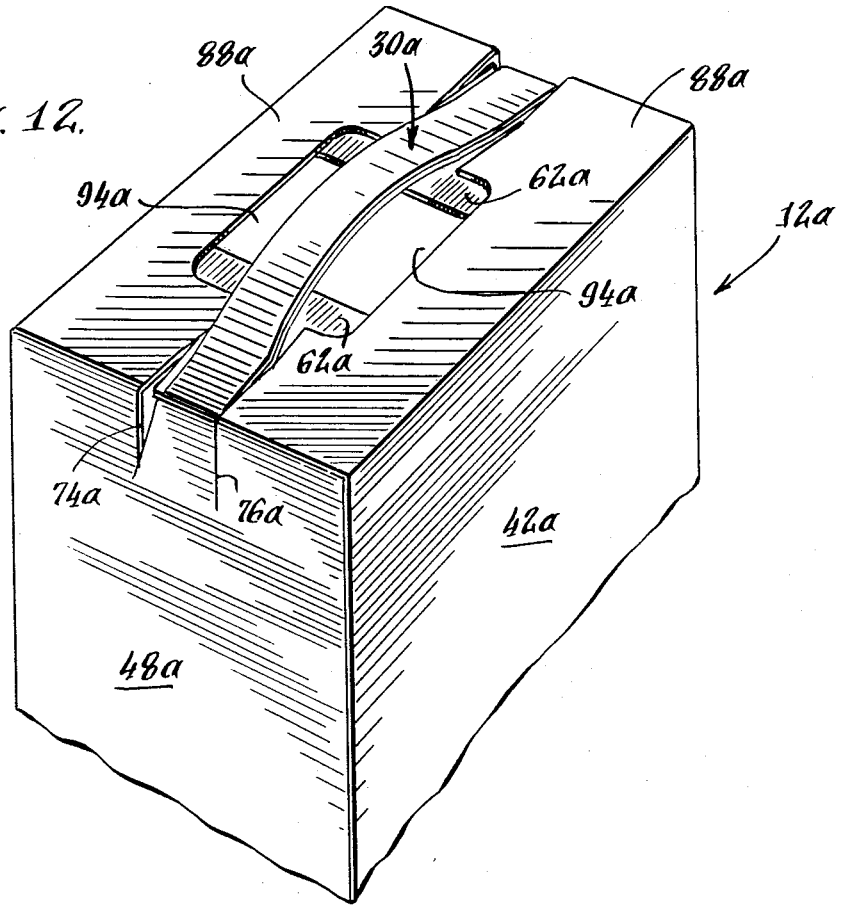
FIG. 12 is a partial perspective view of the carton formed from the blank of FIG. 11.

The blank 40*a* illustrated in FIG. 11 is also used to form a carton 12*a* having a strap-type handle 30*a*. Similar elements corresponding to those in carton 12 and on blank 40 (FIGS. 1 to 10) have been indicated by the identical numeral succeded by the letter a.

The blank 40*a* and carton 12*a* are similar in all respects to blank 40 and carton 12 except that in blank 40*a* the paperboard between die cut bight 80*a* and die cut line 82*a* has been completely removed to leave a cutout area 100 to prevent the tab 72*a* from being caught on bight 80*a* when the handle 30*a* is pulled up to a use position. In addition, the area of overlap between the perforated score line 96*a* and free top edge of panels 88*a* can be expanded for greater strength. Finally the cutout 94*a* can be rectangular in shape rather than semi-circular for greater finger access.

Figure 13:
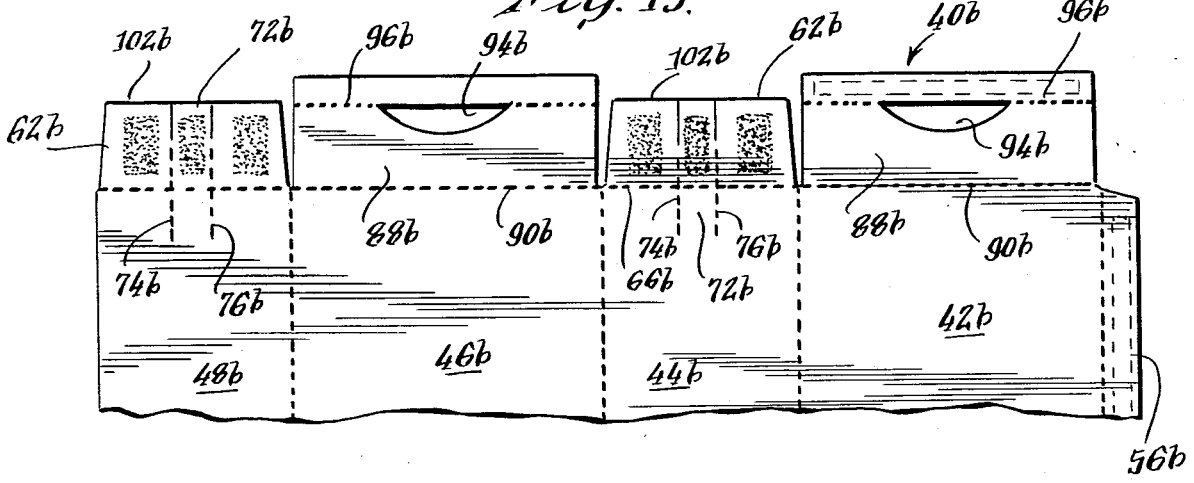
FIG. 13 is a partial plan view of a blank used to form still another modified form of the carton of the invention.
Figure 14:
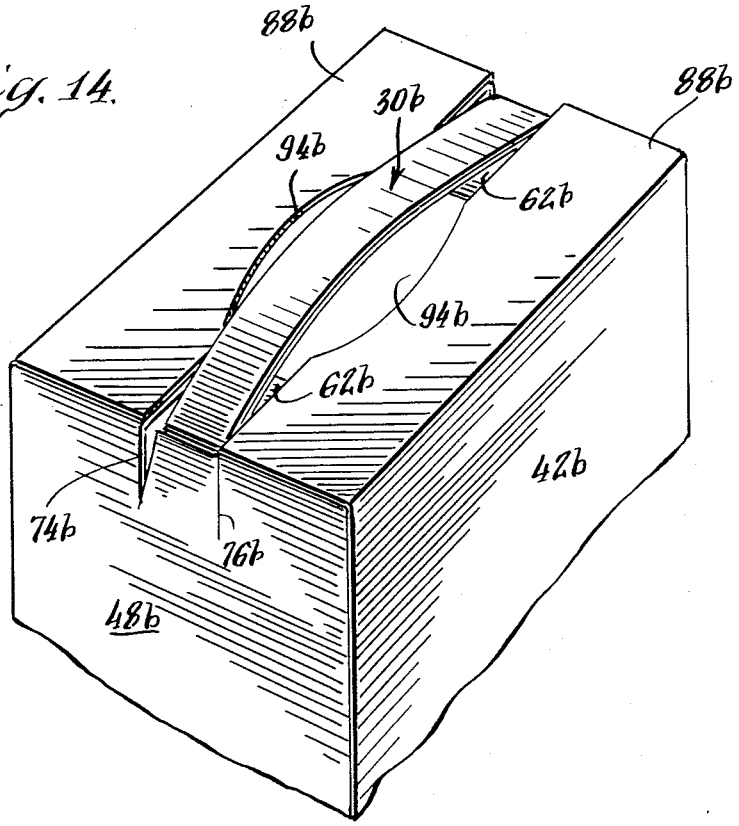
FIG. 14 is a partial perspective view of the carton formed from the blank of FIG. 13.

The blank 40*b* illustrated in FIG. 13 used to form the carton 40*b* (FIG. 14) also is provided with a similar strap-type handle 30*b*. Elements corresponding to those in carton 12 and on blank 40 have been indicated by the identical numeral suceded by the letter b.

The blank 40*b* and carton 12*b* are similar in all respects to blank 40 and carton 12 except that in blank 40*b* the tab 72*b* is formed by parallel score line 74*b*, 76*b* (which are identical to scorelines 74, 76 in function), which extend up to and terminate in free edge 102*b* of each side wall flap 62*b*, eliminating die cut bight 80 and the possibility that the tab 72*b* will bind and the adhesive area 86*b* separate from overlapped panels 88*b*, when the handle 30*b* is lifted. The greater extent or length of contact of each of the side wall tabs 72*b* with the overlapping handle panels of the top wall also provide a sturdier and increased strength handle which further precludes separation of the various plies when under load.

Figure 15:
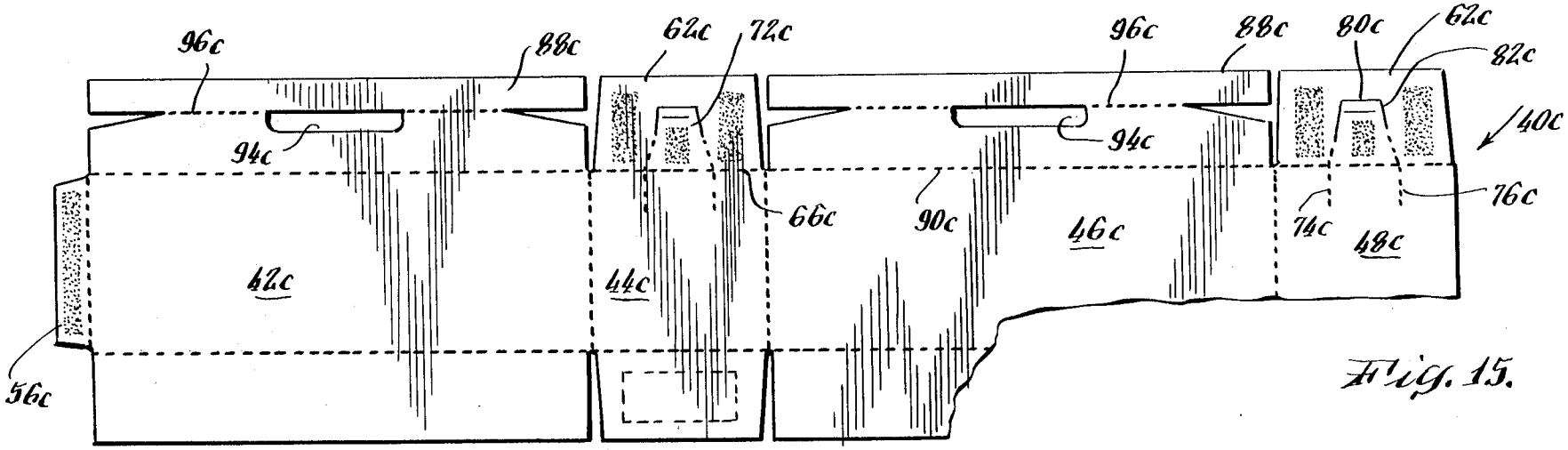
FIG. 15 is a partial plan view of the exterior surface of a blank used to form yet another modified embodiment of the carton of the present invention.
Figure 16:
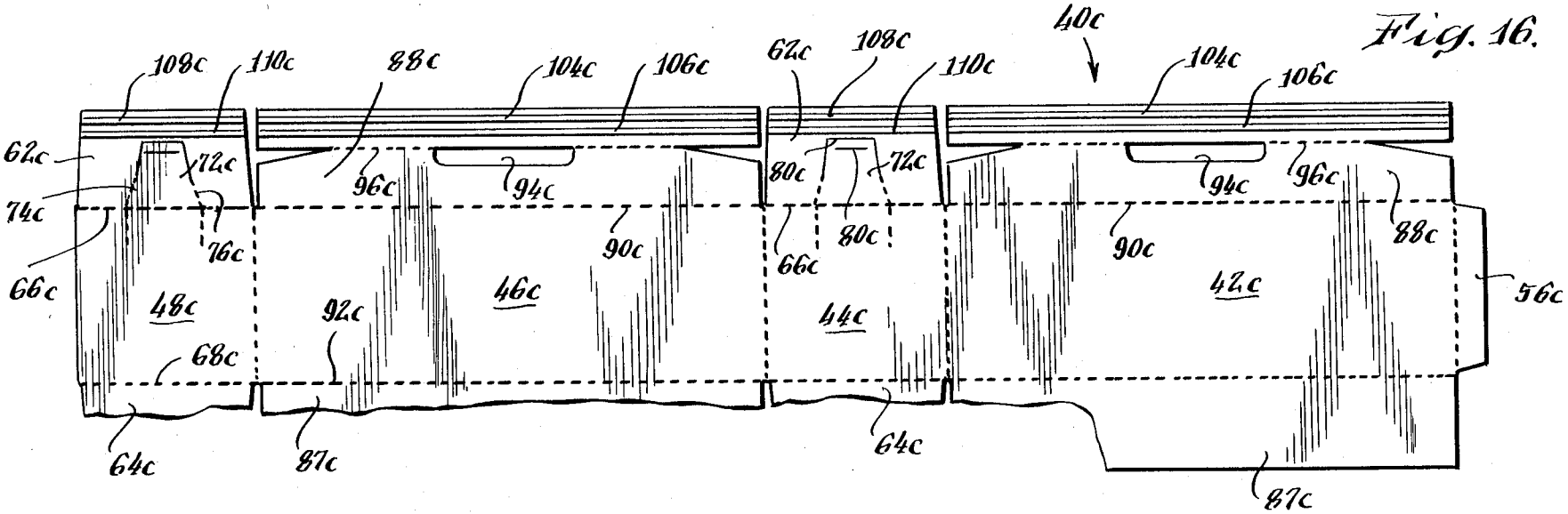
FIG. 16 is a partial plan view of the interior surface of the blank of FIG. 15.

If necessary, the blank and resultant carton can have portions reinforced and stiffened for increased strength when used with heavy loads. As shown in FIGS. 15 and 16, the blank 40*c*, identical in all respects with the blank 40 of FIG. 1 can be provided with parallel reinforcing tape strips 108*c*, 110*c* along the top of each side wall flap 62*c* and reinforcing tape strips 104*c*, 106*c* along and parallel to the top edge of each of the top wall panels 88*c*. The strips 108*c*, 110*c* extend above the bight portion 80*c* of each of the tabs 72*c* provided on each sidewall flap 62*c*. In all other respects, the blank 40*c* is identical to the blank 40 and corresponding elements are indicated by the identical numerals suceded by the letter c.

When folded to form the carton 12*c* in the same manner and sequence as indicated in FIGS. 2–4, the carton 12*c* as shown in FIGS. 18–21, inclusive, will be provided with a pair of parallel reinforcing strips 104*c*, 106*c*, extending beneath each of the inner and outer overlapped handle panels of the handle 30*c*. Reinforcing strips 108*c*, 110*c*, beneath the remaining portions of the top wall of the carton extend along and beneath the side wall flaps 62*c* perpendicular to the strips 104*c*, 106*c* on the handle panel 30*c*. The reinforcing tape strips 104*c*, 106*c*, 108*c*, and 110*c* stiffen the paperboard of the handle panel 30*c* and side flaps 62*c* to withstand larger forces on the walls of the carton provided by a heavier load carried within the interior of the carton.

The tabs 72*c* can also have perforated side edges 74*c* and 76*c* which diverge away from each other for their entire length up to fold line 66*c*. Thus, when handle panel 30*c* is pulled upwardly as indicated in FIG. 21, the separated score lines 74*c*, 76*c* forming the side edges of the side wall tab 72*c* will interfere with or bind against the edges of the opening formerly occupied by the side wall tab 72*c*. This frictional binding will lend increased strength to the handle, especially when the remainder of the side wall flaps 62*c* are stiffened and strengthened by the reinforcing tape strips 108*c*, 110*c*.

What is claimed is:

1. A carton, comprising top and bottom walls;

front, back and side walls connected to said top and bottom walls;

said top wall having inner and outer panels extending from said front and back walls, respectively, and having portions thereof overlapped and secured together;

first and second side flaps extending from opposite top edges of said side walls having portions thereof secured to the lower surface of said overlapped inner and outer top wall panels;

inner and outer elongated handle panels connected together formed from the overlapped portions of said inner and outer top panels and said side flaps, extending substantially parallel to and equally spaced from the top edges of said front and back walls and substantially perpendicular to said side walls, said outer handle panel being defined by a perforated score line formed in said outer top panel which extends lengthwise across said outer top panel and substantially parallel to the top edges of said front and back walls; and said inner handle panel being defined by perforated score line formed in said inner top panel which extends lengthwise across said inner top panel and is substantially parallel to and spaced from the top edges of said front and back walls and the perforated scoreline in said outer top panel, and a substantially U-shaped tab in each of said side flaps having a pair of parallel spaced perforated score lines substantially colinear with and beneath the spaced perforated parallel score lines of said overlapped inner and outer top panels, whereby a handle for said carton is formed by severing said handle panels along said perforated score lines,

2. The carton of claim 1 wherein said U-shaped tab in each of said side flaps has a die-cut bight portion in said side flap connecting one end of said spaced, parallel perforated score lines formed therein, and the other end of said perforated score lines in said side flaps terminating in a spaced relation in one of the side walls connected to said top and bottom walls of said carton.

3. The carton of claim 1 wherein said U-shaped tab is defined by said spaced, parallel perforated score lines and a free edge of said side flap on which said perforated score line terminate.

4. The carton of claim 2 wherein said U-shaped tab includes an internal die cut line parallel to be spaced from said bight portion.

5. The carton of claim 4 wherein the material between said internal die cut line and bight portion is removed from each U-shaped tab.

6. The carton of claim 1 wherein said inner and outer top wall panels include an opening cut in said panel having an edge corresponding with a length of said perforated score line provided in said top wall panel.

7. The carton of claim 6 wherein said openings in said inner and outer top wall panels are substantially semicircular in shape.

8. The carton of claim 6 wherein said openings in said inner and outer top wall panels are substantially rectangular in shape.

9. The carton of claim 6 wherein the distance from said perforated score lines in each of said inner and outer top wall panels to the top edges of said front and back walls, respectively, increases on opposite sides of said opening cut in each of said top wall panels.

10. The carton of claim 6 wherein the distance from said perforated score lines in each of said inner and outer top wall panels to the top edges of said front and back walls, respectively, is uniform throughout the length of said scoreline.

11. A carton, comprising top and bottom walls;

front, back and side walls connected to top and bottom walls;

said top wall having inner and outer panels extending from said front and back walls, respectively, and having portions thereof overlapped and secured together;

first and second side flaps extending from opposite top edges of said side walls having portions thereof secured to the lower surface of said overlapped inner and outer top wall panels;

inner and outer elongated handle panels connected together formed from the overlapped portions of said inner and outer top panels and said side flaps, extending substantially parallel to and equally spaced from the top edges of said front and back walls and substantially perpendicular to said side walls, said outer handle panel being defined by a perforated score line formed in said outer top panel which extends lengthwise across said outer top panel and substantially parallel to the top edges of said front and back walls; and said inner handle panel being defined by a perforated score line formed in said inner top panel which extends lengthwise across said inner top panel and is substantially parallel to and spaced from the top edges of said front and back walls and the perforated scoreline in said outer top panel, and a substantially U-shaped tab in each of said side flaps defined by a pair of score lines beneath the spaced perforated parallel score lines of said overlapped inner and outer top panels, whereby a handle for said carton is formed by severing said handle panels along said perforated score lines.

12. The carton of claim 11 wherein said pair of score lines defining said U-shaped tab in each of said side flaps diverge away from each other from the ends of the bight porion of said U-shaped tab.

13. The carton of claim 11 including a strip of reinforcing tape adjacent the top edge of each of said side wall flaps and extending along the interior surface of said overlapped handled panels.

14. The carton of claim 1 including a strip of reinforcing tape adjacent the top edge of each of said side wall flaps and extending along the interior surface of said overlapped handled panels, so as to provide reinforcement for said handle.

* * * * *